US006505593B2

(12) United States Patent
Fujii

(10) Patent No.: US 6,505,593 B2
(45) Date of Patent: Jan. 14, 2003

(54) VALVE SPRING SET LOAD CHANGING DEVICE IN A VALVE MOVING APPARATUS OF AN INTERNAL COMBUSTION ENGINE

(75) Inventor: Noriaki Fujii, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/895,289

(22) Filed: Jun. 29, 2001

(65) Prior Publication Data

US 2002/0050262 A1 May 2, 2002

(30) Foreign Application Priority Data

Jul. 3, 2000 (JP) ..... 2000-201343

(51) Int. Cl.[7] ..... F01L 3/10
(52) U.S. Cl. ..... 123/90.66; 123/90.67
(58) Field of Search ..... 123/90.65, 90.66, 123/90.67, 188.17, 188.13

(56) References Cited

U.S. PATENT DOCUMENTS 4,446,825 A * 5/1984 Giardini et al. ..... 123/90.65
5,558,054 A * 9/1996 Ariga et al. ..... 123/90.65
5,664,531 A * 9/1997 Kim ..... 123/90.65

FOREIGN PATENT DOCUMENTS

JP 10299435 A 11/1998

* cited by examiner

*Primary Examiner*—Wellun Lo
(74) *Attorney, Agent, or Firm*—Lahive & Cockfield, LLP

(57) ABSTRACT

A valve moving apparatus of an internal combustion engine comprises an engine valve, a valve spring, a spring seat supporting an end of the valve spring and a cam driving the engine valve to open. A valve spring set load changing device in the valve moving apparatus comprises the spring seat including a base seat and a support seat movable relatively to the base seat, an actuator generating drive force in accordance with an operational condition of the engine and a manipulating mechanism transmitting the drive force to the support seat. The actuator and the manipulating mechanism are positioned outside of the spring seat. When the support seat is rotated by a predetermined amount by the drive force transmitted through the manipulating mechanism, the support seat moves also in direction of expansion and contraction of the valve spring to change set load of the valve spring.

7 Claims, 10 Drawing Sheets

VALVE SPRING SET LOAD CHANGING DEVICE IN A VALVE MOVING APPARATUS OF AN INTERNAL COMBUSTION ENGINE

BACKGROUND OF THE INVENTION

1. Field of the Invention

The present invention relates to a valve moving apparatus of an internal combustion engine, particularly to a valve spring set load changing device in a valve moving apparatus for changing set load of a valve spring of an engine valve in accordance with operational condition of the internal combustion engine.

2. Description of the Related Art

Hitherto, set load of a valve spring of an engine valve, namely an intake valve or an exhaust valve, has been set based on inertia force of a valve moving system at the highest rotational speed of the engine so that jumping and bounce of the engine valve does not occur even by inertia force of the valve moving system at the highest rotational speed. Since the inertia force increases in proportion to a square of rotational speed of the engine, the set load of the valve spring is also set at a value proportional to a square of the rotational speed. Therefore, at low and middle rotational speed region of the engine, the set load of the valve spring is unnecessarily large, so that rate of frictional output loss to engine output is increased.

Accordingly, various arts for changing set load of the valve spring in accordance with rotational speed of an internal combustion engine have been proposed. For example, Japanese Laid-Open Patent Publication Hei 10-299435 discloses a valve spring load changing apparatus for a moving valve of an internal combustion engine. In this apparatus, a spring seat of the valve spring for forcing the moving valve (intake valve or exhaust valve) in direction to open includes an upper seat supporting an end of the valve spring and a lower seat. A lower surface of the upper seat and an upper surface of the lower seat are formed with respective tapered surfaces and pressure receiving surfaces, and the upper and lower seats are houses in a seat case disposed on a recessed spring bearing seat on a cylinder head in a state that the tapered surfaces are contacted with each other so as to rotate relatively. The tapered surfaces, the pressure receiving surfaces and the seat case form an oil pressure chamber of a hydraulic actuator.

When the engine is in a low rotational speed region and pressure in the oil pressure chamber is low, the upper seat occupies a lower limit position in a state that the pressure receiving surfaces of the upper and lower seats are contacted with each other. When the engine is in a high rotational speed region and pressure in the oil pressure chamber is high, the upper and lower seats rotate relatively in a state that the tapered surfaces are contacted with each other while the upper seat rises from the lower limit position, then the upper seat is held at a balanced stop position corresponding to the oil pressure. Thus, spring force of the valve spring increases in proportion to increase of the rotational speed.

According to the above-mentioned related art, since the hydraulic actuator including the spring seats is formed within the seat case and the cylinder head must be provided with a circumferential wall of a specific height for forming the recessed spring bearing seat housing the seat case, a relatively wide and high zone around the spring seat is occupied by the seat case and the spring bearing seat. Moreover, each of the intake valves and the exhaust valves require the hydraulic actuator and the spring seat. Therefore, a part of the cylinder head around the spring seat becomes large to make the entire cylinder head large and heavy, and degree of freedom of arrangement of the intake valves and the exhaust valves is restricted.

SUMMARY OF THE INVENTION

The present invention has been accomplished in view of the foregoing. According to the valve spring set load changing device of the present invention, it can be restrained that the cylinder head is made large and heavy, and arrangement of engine valves is restricted little. Further, stable and certain change of the set load and cost reduction of the internal combustion engine can be intended. And a set load can be maintained stably.

The present invention provides a valve spring set load changing device in a valve moving apparatus of an internal combustion engine having an engine valve for opening and closing a port of a combustion chamber connected with an intake passage or an exhaust passage, a valve spring for forcing the engine valve in a closing direction, a spring seat for supporting an end of the valve spring and a cam for opening the engine valve against the valve spring, wherein the spring seat includes a base seat and a support seat supporting the end of the valve spring and movable relatively to the base seat, the base seat and the support seat are provided with a direction changing mechanism for changing relative movement between the base seat and the support seat into movement of the support member in direction of expansion and contraction of the valve spring, an actuator for generating a drive force in accordance with an operational condition of the internal combustion engine and a manipulating mechanism connected with the actuator are provided outside of the spring seat, and at least one of the support seat and the base seat constitutes a driven seat driven by the drive force transmitted through the manipulating mechanism to cause the relative movement of a predetermined amount for- changing set load of the valve spring.

According to this invention, when the drive force generated by the actuator is transmitted to the driven seat through the manipulating mechanism, a relative movement is caused between the support seat and the base seat, and the relative movement is changed into a movement of the support member in direction of expansion and contraction of the valve spring by the direction changing mechanism to change set load of the valve spring. The driven seat is driven through the actuator and the manipulating mechanism disposed outside of the spring seat and it is required only that the manipulating mechanism engaging with the driven seat is disposed in the neighborhood of the spring seat. Therefore, arrangement of the engine valve is restricted little.

Since a manipulating mechanism separated from the cylinder head can be disposed in a portion around the spring seat, a part of the cylinder head around the spring seat is not enlarged, so that it can be restrained that the entire cylinder head becomes large and heavy. Since the manipulating mechanism and the driven seat can be engaged with each other in any position around the spring seat, degree of freedom of arrangement of the driven seat and the manipulating mechanism is large, and arrangement of the engine valve is restricted little by the set load changing device.

The manipulating mechanism may have a rod connected to the actuator, and an engaging section of the rod and an engaging section of the driven seat may be engaged with each other to connect the driven seat with the manipulating mechanism.

Since the driven seat is driven through the rod connected to the actuator, the actuator can be disposed at a place distant from the spring seat, for example, at an end portion of the cylinder head. As the result, degree of freedom of arrangement of the actuator becomes large and arrangement of the engine valve is almost not restricted by the set load changing device.

The internal combustion engine may have a cylinder head provided with an insertion hole for inserting a ignition plug or a fuel injection valve facing the combustion chamber, and the rod may be disposed between the engine valve and the insertion hole.

The rod is disposed utilizing a relatively narrow space between the engine valve and the ignition plug or the fuel ignition valve. As the result, the manipulating mechanism can be disposed within the cylinder head compactly and enlargement of the cylinder head can be restrained.

The internal combustion engine may have the engine valves with the respective driven seats, and the driven seats may be connected with a single manipulating mechanism.

Since the driven seats for the respective engine valves is driven by the single manipulating mechanism, number of parts is reduced, assembling is easy, and enlargement and increase in weight of the cylinder head can be restrained.

The support seat may support a plurality of the valve springs.

Since some valve springs are supported by a common support seat, number of parts is reduced, number of actuators and manipulating mechanisms is also reduced, assembling is easy, and restriction of arrangement of other members by the set load changing device is few.

Preferably, the drive force of the actuator is set so that the driven seat is driven to cause the relative movement of the predetermined amount only when the engine valve is closed, the manipulating mechanism has a elastic deformation member storing the drive force generated by the actuator, and the drive force is transmitted to the driven seat through the elastic deformation member.

If drive force of the actuator acts on the driven seat through the manipulating mechanism when the engine valve is closed, the valve spring is elongated and spring force of the valve spring is the minimum, the relative movement of the predetermined amount is caused between the support seat and the base seat, and the support seat is moved in direction of expansion and contraction of the valve spring by the direction changing mechanism so that set load of the valve spring is changed. If the actuator generates the drive force in case the engine valve is opened when the valve spring is more compressed and spring force of the valve spring is larger compared with the case the engine valve is closed, the drive force of the actuator acts on the driven seat through the elastic deformation member. However, since spring force of the valve spring is larger than that in case the engine valve is closed, the driven seat can not be moved so as to cause the relative movement of the predetermined amount. Therefore, the elastic deformation member is deformed to store the drive force. When the cam rotates further and the engine valve is closed to reduce spring force of the valve spring to the minimum, the driven seat is driven by the drive force stored in the elastic deformation member, the relative movement of the predetermined amount is caused between the support seat and the base seat and set load of the valve spring is changed. In case that plural driven seats for respective engine valves are driven by a common manipulating mechanism, set loads of the valve springs are changed in order when respective engine valves are closed.

Thus, if the drive force of the actuator is previously set at a specific value capable of driving the driven seat when the engine valve is closed, the set load can be changed stably and certainly at a specific time, that is, when the engine valve is closed. Since there is no need to adjust timing of generating the drive force, a control system of the actuator becomes simple and cost of the engine is reduced. This is the same in case that plural driven seats are driven by a common manipulating mechanism.

Preferably, the support seat has a first position where the set load of the valve spring is set at a first set value and a second position where the set load of the valve spring is set at a second set value larger than the first set value by movement of the support seat in direction to contract the valve spring, and at the second position, the base seat and the support seat comes into contact with each other through contact surfaces on a plane right-angled to a line of action of spring force of the valve spring.

Because at the second position where the set load is larger the base seat and the support seat comes into contact with each other through contact surfaces on a plane perpendicular to a line of action of spring force of the valve spring, even if a large spring force acts on the support seat and the base seat when the engine valve is opened, no component force to slip the base seat and the support seat relatively is not generated, and fluctuation of the set load can be prevented.

Therefore, even when the support seat is positioned at the second position and the large spring force acts, relative movement between the base seat and the support seat is prevented, and the set load set in accordance with an operational condition of the engine can be maintained stably.

DETAILED DESCRIPTION OF THE PREFERRED EMBODIMENT

Hereinafter, some embodiments of the present invention will be described with reference to FIGS. 1 to 10.

Figure 1:
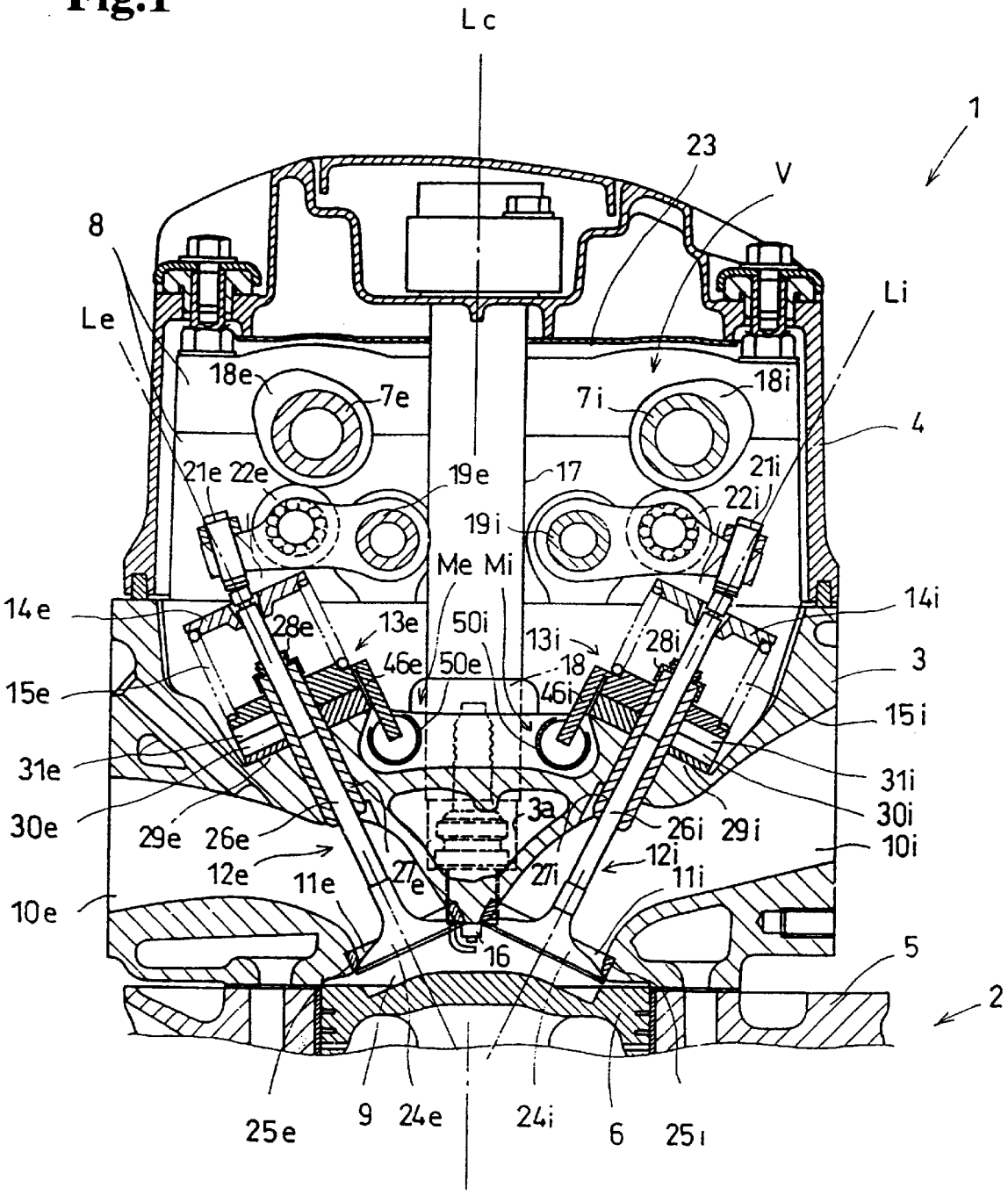
FIG. 1 is a partial vertical sectional view of an internal combustion engine having a valve spring set load changing device according to a first embodiment of the present invention.
Figure 2:
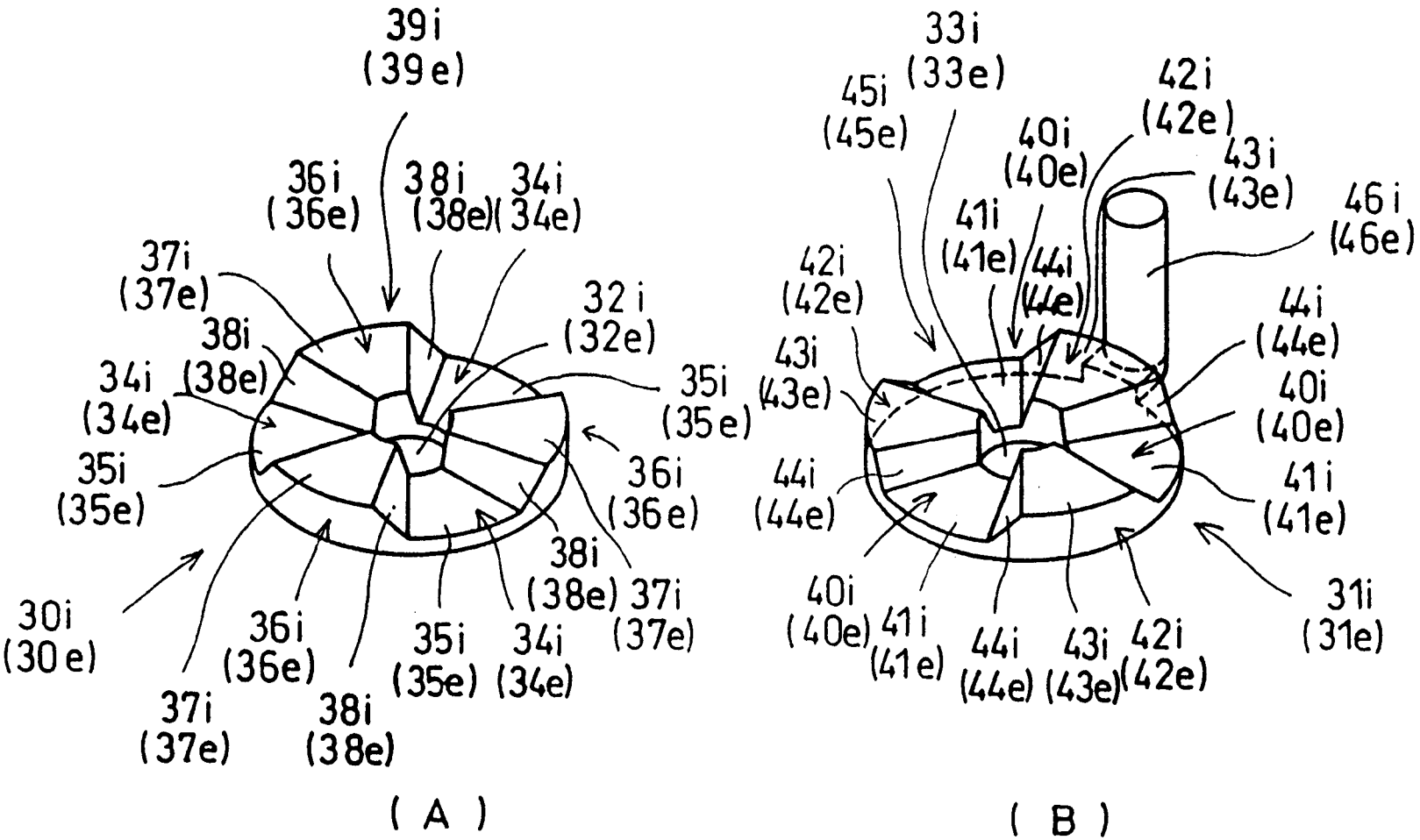
FIG. 2A is a perspective view of a base seat constituting a part of a spring seat of the valve spring set load changing device of FIG. 1 showing an upper surface thereof.
FIG. 2B is a perspective view of a support seat constituting another part of the spring seat showing a lower surface thereof.

FIGS. 1 to 9 show a first embodiment of the present invention, and the internal combustion engine 1 having a valve spring set load changing device according to the present invention is a DOHC type 4-cylinder 4-stroke-cycle internal combustion engine for a vehicle. Referring to FIG. 1, on an upper surface of a cylinder block 2 is attached a cylinder head and on an upper surface of the cylinder head 3 is attached a cylinder head cover 4. A piston 6 fitted in each cylinder 5 so as to reciprocate is connected to a crankshaft (not shown) through a connecting rod (not shown). An intake camshaft 7*i* and an exhaust camshaft 7*e* are arranged in direction of row of cylinders in parallel with each other and rotatably supported by plural cam holders 8 fixed to the cylinder head 3 by bolts. The camshafts 7*i*, 7*e* are rotated synchronizing with the crankshaft at a speed reduction ratio of 1/2. In this specification, "upper" and "lower" mean those in FIG. 1.

Every cylinder 5 has a combustion chamber 9 formed between the piston 6 and the cylinder head 3. The combustion chamber 9 has an intake port 11*i* connected with an intake passage 10*i* and an exhaust port 11*e* connected with an exhaust passage 10*e*. An intake valve 12*i* and an exhaust valve 12*e*, which are poppet valves for opening and closing the intake port 11*i* and the exhaust port lie, are provided in the cylinder head 3 so as to slide. The intake valve 11*i* and the exhaust valve 11*e* are forced in closing direction by valve springs 15*i*, 15*e* compressed between spring seats 13*i*, 13*e* placed on the cylinder head 3 and retainers 14*i*, 14*e* provided at upper ends of valve stems 26*i*, 26*e*. The intake valve 12*i* and the exhaust valve 12*e* constitute respective engine valves. A ignition plug 16 screwed to the cylinder head 3 so as to face the combustion chamber is inserted in a insertion hole 18 formed by a hole 3 provided in the cylinder head 3 and a pipe 17 fixed to the cylinder head 3. A center axis of the insertion hole 18 is disposed on a plane including a center axis Lc of the cylinder 5 and parallel with the camshafts 7*i*, 7*e*.

An intake cam 18*i* and an exhaust cam 18*e* integrally provided on the intake camshaft 7*i* and the exhaust camshaft 7*e* respectively have nose portions projected with a predetermined projecting amount radially and over a predetermined operation angle circumferentially and base circle portions.

Below the intake camshaft 7*i*, an intake rocker shaft 19*i* is fixed to the cam holder 8, and an intake rocker arm 20*i* is pivoted on the intake rocker shaft 19*i*. An adjustable tappet screw 21*i* provided at a tip end of the rocker arm 20*i* touches an upper surface of a valve stem 26*i* of the intake valve 12*i*. The intake rocker arm 20*i* has a roller 22*i* coming into sliding contact with the intake cam 18*i*. The rocker arm 20*i* is moved by the intake cam 18*i* through the roller 22*i*.

Similarly, below the exhaust camshaft 7*e*, an exhaust rocker shaft 19*e* is fixed to the cam holder 8, and an exhaust rocker arm 20*e* is pivoted on the exhaust rocker shaft 19*e*. An adjustable tappet screw 21*e* provided at a tip end of the rocker arm 20*e* touches an upper surface of a valve stem 26*e* of the exhaust valve 12*e*. The exhaust rocker arm 20*e* has a roller 22*e* coming into sliding contact with the exhaust cam 18*e*. The rocker arm 20*e* is moved by the exhaust cam 18*e* through the roller 22*e*.

Therefore, the intake valve 12*i* is opened against spring force of the valve spring 15*i* with a lift amount and an operation angle determined by the nose portion of the intake cam 18*i*, and the exhaust valve 12*e* is opened against spring force of the valve spring 15*e* with a lift amount and an operation angle determined by the nose portion of the exhaust cam 18*e*.

The intake valve 12*i*, the exhaust valve 12*e*, the valve springs 15*i*, 15*e*, the spring seats 13*i*, 13*e*, the intake camshaft 7*i*, the exhaust camshaft 7*e*, the intake rocker shaft 19*i*, the exhaust rocker shaft 19*e*, the intake cam 18*i*, the exhaust cam 18*e*, the intake rocker arm 20*i* and the exhaust rocker arm 20*e* constitute the valve moving apparatus V housed within a valve moving chamber 23 formed between the cylinder head 3 and the cylinder head cover 4.

When the intake valve 12*i* (the exhaust valve 12*e*) is opened, a cap section 24*i* (24*e*) of the valve is projected into the combustion chamber 9, and the intake valve 12*i* (the exhaust valve 12*e*) is closed, a valve face of the cap section 24*i* (24*e*) is seated onto a valve seat 25*i* (25*e*) formed on a peripheral edge of the intake port 11*i* (the exhaust port 11*e*). The valve stem 26*i* (26*e*) of the intake valve 12*i* (the exhaust valve 12*e*) penetrates a cylindrical valve guide 27*i* (27*e*) fixed to the cylinder head 3 and reciprocate within the valve guide 27*i* (27*e*). On an upper end of the valve guide 27*i* (27*e*) is fitted an oil seal 28*i* (28*e*) for preventing oil in the valve moving chamber 23 from leaking to the intake passage 101 (the exhaust passage 10*e*).

The spring seat 13*i* (13*e*) placed on a flat receiving seat 29*i* (29*e*) includes a circular base seat 301 (30*e*) and a circular support seat 31*i* (31*e*). The base seat 30*i* (30*e*) has a lower insertion hole 32*i* (32*e*) penetrated by the valve guide 27*i* (27*e*), and the support seat 31*i* (31*e*) has an upper insertion hole 33*i* (33*e*) penetrated by the valve guide 27*i* (27*e*). The seats 30*i*, 31*i* (30*e*, 30*e*) are rotatable relatively to each other about an axis Li (Le) of the intake valve 12*i* (the exhaust valve 12*e*). Namely, the base seat 30*i* (30*e*) is fixed to the receiving seat 29*i* (29*e*) with a fixing member (not shown) provided on a lower surface or an outer peripheral surface of the base seat 30*i* (30*e*),while the support seat 31*i* (31*e*) is disposed on the base seat 30*i* (30*e*) so as to rotate about the axis Li (Le) of the intake valve 12*i* (the exhaust valve 12*e*). The support seat 31*i* (31*e*) has an upper surface for supporting an end of the valve spring 151 (15*e*).

An upper surface of the base seat 30*i* (30*e*) facing the support seat 31*i* (31*e*) has three bottom sections 34*i* (34*e*) and three top sections 36*i* (36*e*) arranged circumferentially alternately. The bottom section 34*i* (34*e*) has a first contact surface 35*i* (35*e*) formed in parallel with a plane right-angled to the axis Li (Le) of the intake valve 12*i* (the exhaust valve 12*e*) (hereinafter, called as "right-angled plane"). The top section 36*i* (36*e*) has a second contact surface 37*i* (37*e*) formed in parallel with the right-angled plane. Each circumferential end of the first contact surface 35*i* (35*e*) is connected with a circumferential end of the corresponding second contact surface 37*i* (37*e*) through an inclined surface 38*i* (38*e*). The first and second contact surfaces 35*i*, 37*i* (35*e*, 37*e*) and the inclined surfaces 38*i* (38*e*) form a lower cam surface 39*i* (39*e*).

A lower surface of the support seat 31*i* (31*e*) facing the base seat 30*i* (30*e*) has three bottom sections 40*i* (40*e*) and three top sections 42*i* (42*e*) arranged circumferentially alternately. The bottom section 40*i* (40*e*) has a first contact surface 41*i* (41*e*) formed in parallel with the right-angled plane and the top section 42*i* (42*e*) has a second contact surface 43*i* (43*e*) formed in parallel with the right-angled plane. Each circumferential end of the first contact surface 41*i* (41*e*) is connected with a circumferential end of the corresponding second contact surface 43*i* (43*e*) through an inclined surface 44*i* (44*e*). The first and second contact surfaces 41*i*, 43*i* (41*e*, 43*e*)and the inclined surfaces 44*i* (44*e*) form a lower cam surface 45*i* (45*e*). The upper seat 31*i* (31*e*) has a columnar projecting piece 46*i* (46*e*) extending downward from an outer periphery of the upper seat 31*i* (31*e*) for engaging with a manipulating mechanism Mi (Me).

Figure 3:
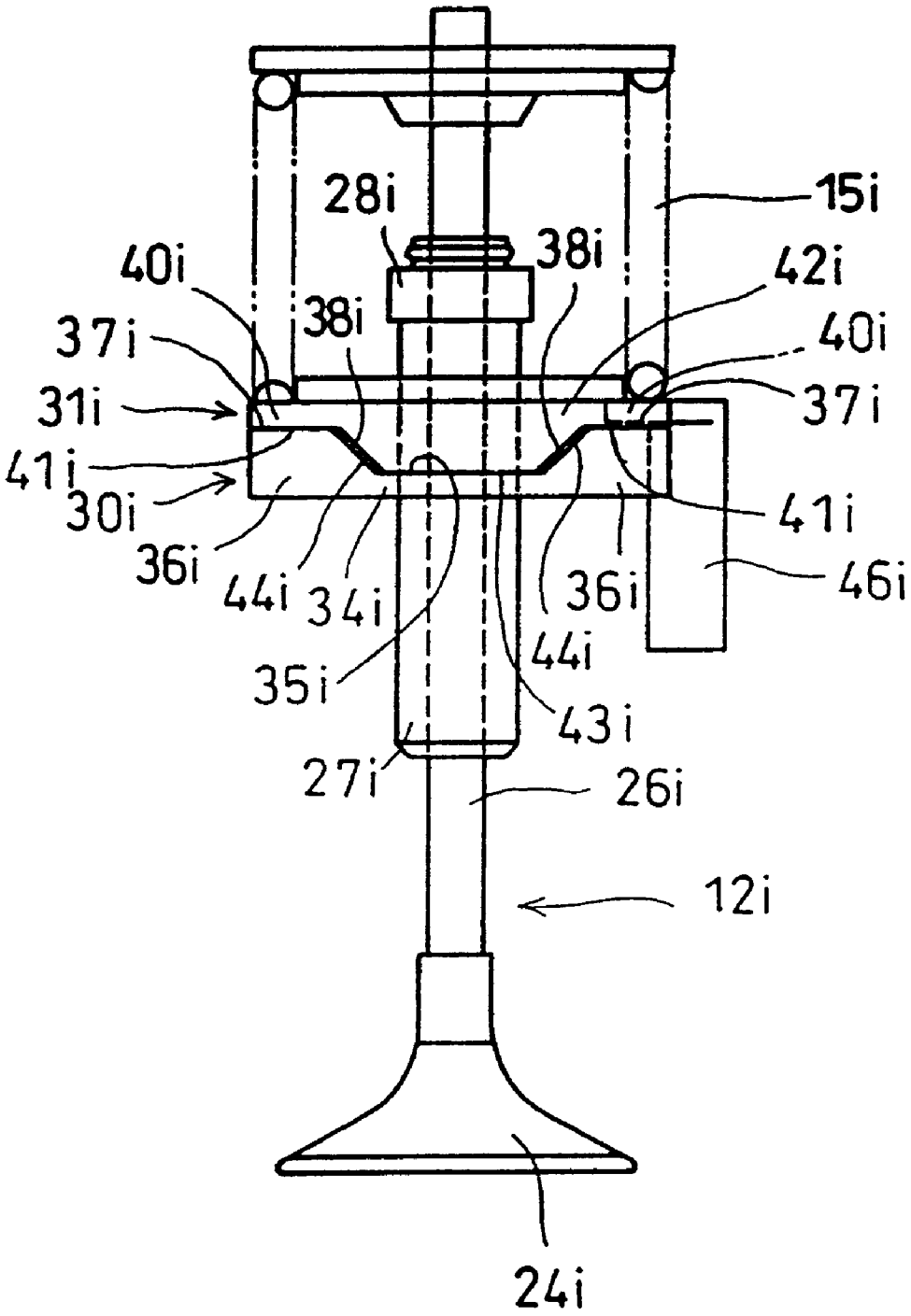
FIG. 3 is a side view of an intake valve with the support seat occupying a first position.

When the support seat 31*i* (31*e*) occupies a first position relative to the base seat 30*i* (30*e*) as shown in FIG. 3, the bottom section 34*i* (34*e*) and the top section 36*i* (36*e*) of the base seat 30*i* (30*e*) are opposite to the top section 42*i* (42*e*) and the bottom section 40*i* (40*e*) of the support seat 31*i* (31*e*) respectively, the first contact surface 35*i* (35*e*) is contacted with the second contact surface 43*i* (43*e*) almost entirely, the second contact surface 37*i* (37*e*) is contacted with the first contact surface 41*i* (41*e*) almost entirely, and a slight gap is formed between the inclined surface 38*i* (38*e*) of the lower cam surface 39*i* (39*e*) and the inclined surface 44*i* (44*e*) of the upper cam surface 45*i* (45*e*). When the support seat occupies the first position, the valve spring 15*i* (15*e*) is most expanded in the state that the intake valve 12*i* (the exhaust valve 12*e*) is closed. Spring force of the valve spring 15*i* (15*e*) at this state is a first set value of set load of the valve spring 15*i* (15*e*).

Figure 4:
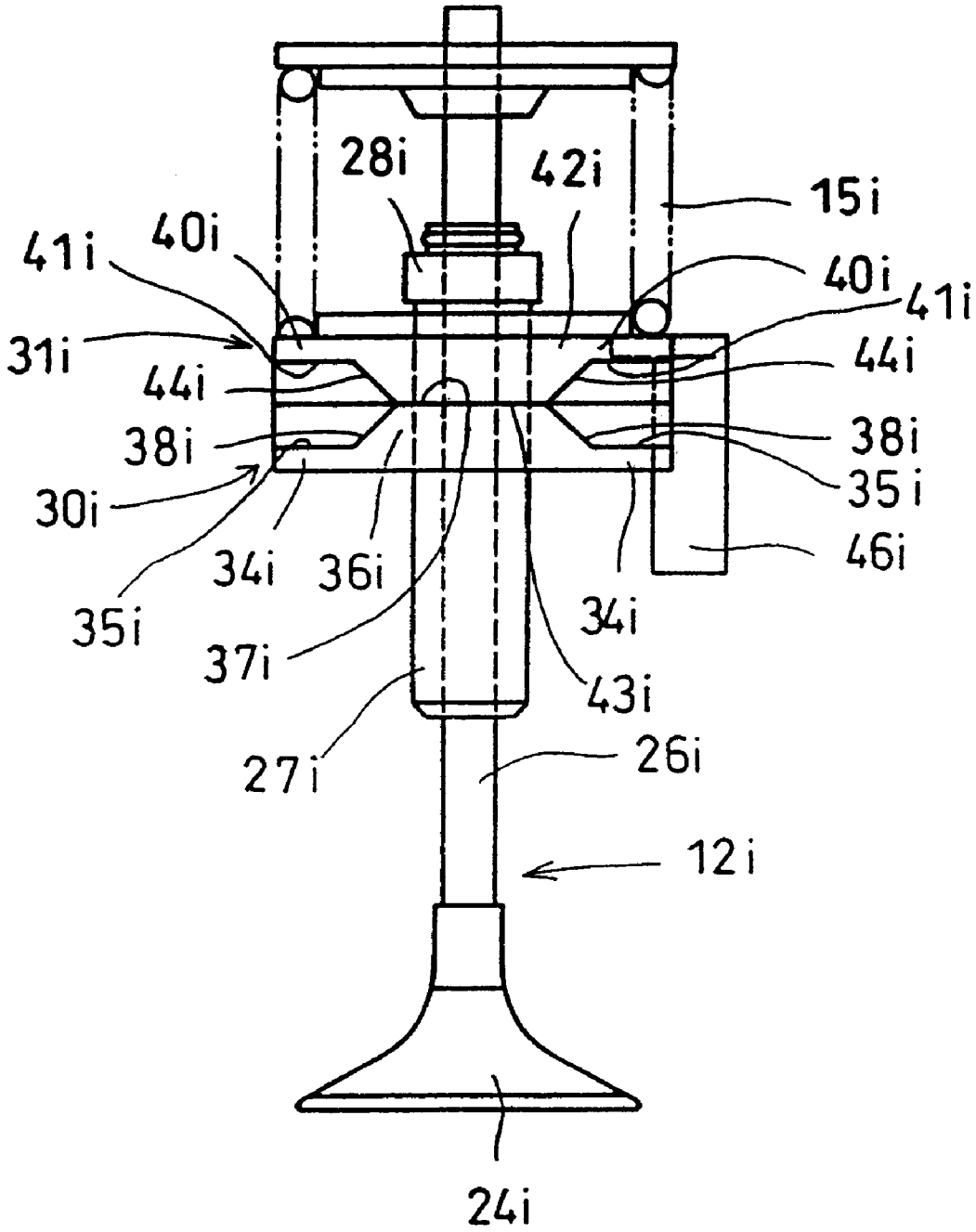
FIG. 4 is a side view of the intake valve with the support seat occupying a second position.

When the support seat 31*i* (31*e*) rotates by a predetermined amount relatively to the base seat 30*i* (30*e*) and occupies a second position as shown in FIG. 4, the bottom section 34*i* (34*e*) and the top section 36*i* (36*e*) of the base seat 30*i* (30*e*) are opposite to the bottom section 40*i* (40*e*) and the top section 42*i* (42*e*) of the support seat 31*i* (31*e*) respectively, the second contact surface 37*i* (37*e*) and the second contact surface 43*i* (43*e*) are contacted with each other almost entirely, and gaps are formed between the first contact surface 35*i* (35*e*) and the first contact surface 41*i* (41*e*) and between the inclined surface 38*i* (38*e*) and the inclined surface 44*i* (44*e*). At the second position, the valve spring 15*i* (15*e*) is most contracted in the state that the intake valve 12*i* (the exhaust valve 12*e*) is closed. Namely, set load of the valve spring 15*i* (15*e*) is set at a second set value larger than the first set value.

The above-mentioned first set value is determined based on inertia force of the valve moving system at a highest rotational speed in a low rotational speed region, and the above-mentioned second set value is determined based on inertia force of the valve moving system at a highest rotational speed in a high rotational speed region.

The inclined surfaces 38*i*, 44*i* (38*e*, 44*e*) of the lower cam surface 39*i* (39*e*) and the upper cam surface 45*i* (45*e*) form guide surfaces for facilitating shift of the support seat 31*i* (31*e*) from the first position to the second position and from the second position to the first position. When the support seat shifts, the inclined surface 44*i* (44*e*) of the support seat 31*i* (31*e*) slides on the inclined surface 38*i* (38*e*) of the base seat 30*i* (30*e*). Inclination angles of the inclined surfaces 38*i*, 44*i* (38*e*, 44*e*) are suitably determined so that smooth shift of the support seat 31*i* (31*e*) between the first and second positions is possible.

Thus, the lower cam surface 39*i* (39*e*) and the upper cam surface 45*i* (45*e*) constitute a direction changing mechanism for changing relative rotation of the support seat 31*i* (31*e*) to the base seat 30*i* (30*e*) into movement of the support seat 31*i* (31*e*) in direction of expansion and contraction of the valve spring 15*i* (15*e*).

As shown in FIG. 1, in a relatively narrow space between the intake valve 12*i* (the exhaust valve 12*e*) and the insertion hole 18 is disposed a straight tubular rod 50*i* (50*e*) in parallel with the intake camshaft 7*i* (the exhaust cam shaft 7*e*). The rod 50*i* (50*e*) belongs to a manipulating mechanism Mi (Me) which is an element of a set load changing device Di (De).

Figure 5:
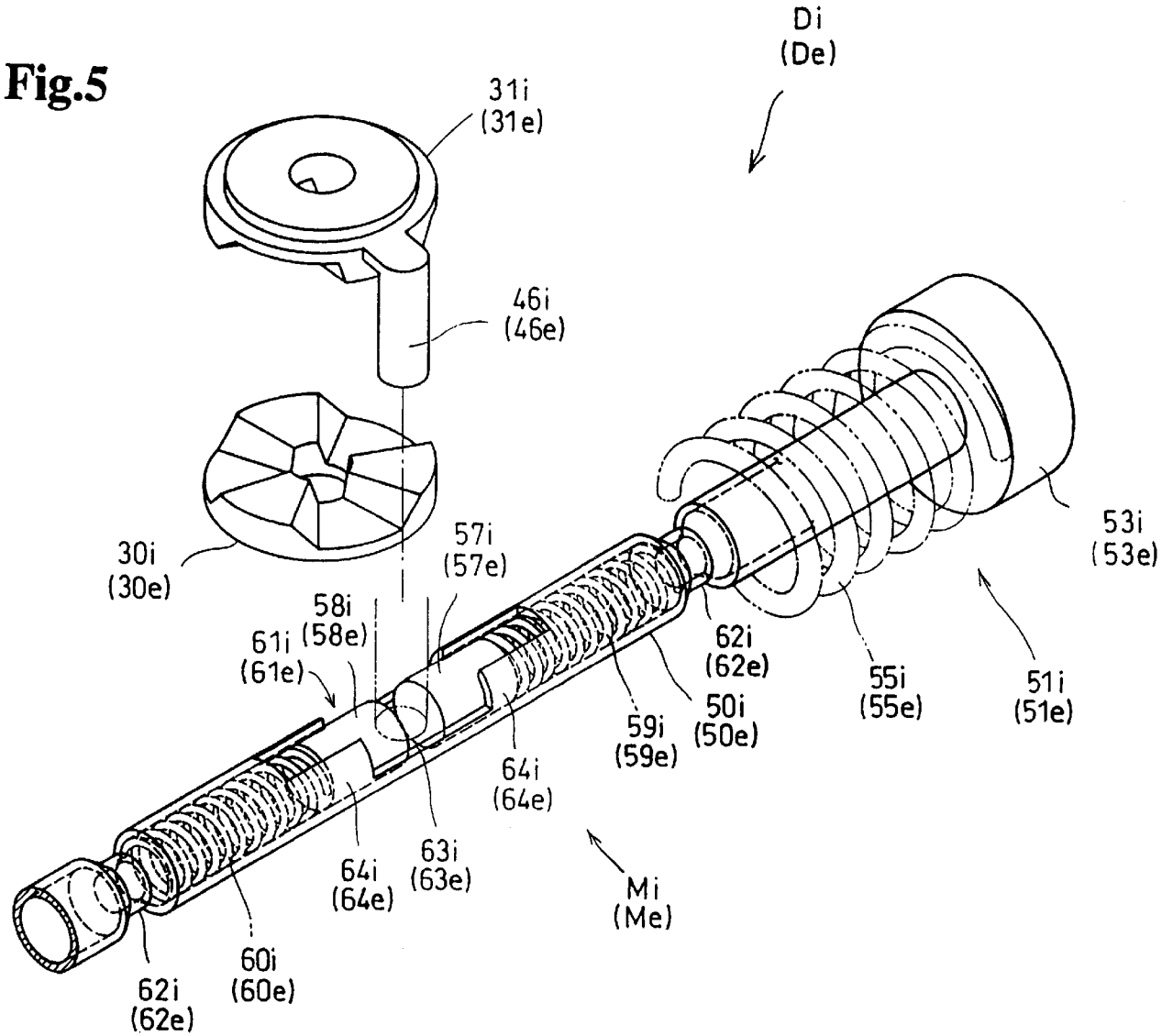
FIG. 5 is a partial perspective view of the set load changing device of FIG. 1.
Figure 6:
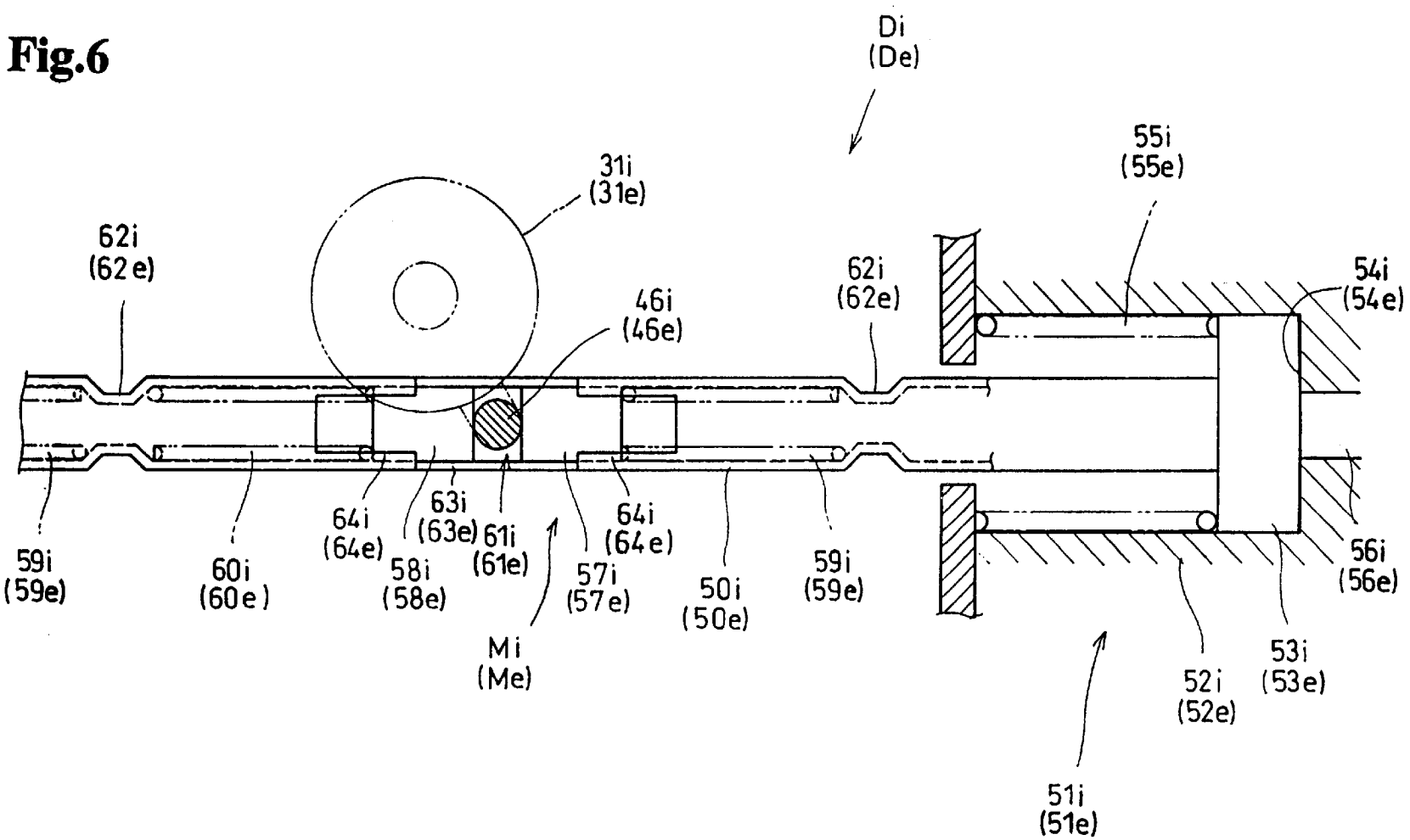
FIG. 6 is a view for explaining operation of the set load changing device in which the support seat occupies the first position.

As shown in FIGS. 5 and 6, the set load changing device Di (De) comprises the spring seat 31*i* (31*e*), an actuator 51*i* (51*e*) and the manipulating mechanism Mi (Me) connected to the actuator 51*i* (51*e*).

The actuator 51*i* (51*e*) is a hydraulic actuator and comprises an oil pressure cylinder 52*i* (52*e*) formed in the cylinder head 3 integrally at an end in direction of row of cylinders thereof, a drive piston 53*i* (53*e*) fitted in the hydraulic oil pressure cylinder 52*i* (52*e*), an oil pressure chamber formed between the hydraulic cylinder 52*i* (52*e*) and the drive piston 53*i* (53*e*), and a return spring 55*i* (55*e*) forcing the drive piston 53*i* (53*e*) toward a bottom surface of the hydraulic cylinder 52*i* (52*e*). An oil passage 56*i* (56*e*) is opened at the bottom surface of the oil pressure chamber 54*i* (54*e*) and working oil is supplied to the oil pressure chamber 54*i* (54*e*) through the oil passage 56*i* (56*e*). The working oil is a part of oil discharged from an oil pump driven by the crankshaft of the engine 1 and pressure of the working oil is controlled into a low oil pressure or a high oil pressure by a oil pressure control valve (not shown). Action of the oil pressure control valve is controlled by a control apparatus (not shown) to which a detection signal from a rotational speed sensor (not shown) detecting engine rotational speed (a sensor detecting operational condition of the engine 1) is inputted.

When the rotational speed sensor detects a rotational speed lower than a predetermined rotational speed, pressure in the oil pressure chamber 54*i* (54*e*) becomes low, and the actuator 51*i* (51*e*) becomes a first state that the drive piston 53*i* (53*e*) is pushed against the bottom surface by the return spring 55*i* (55*e*) to occupy a retarded position. When the rotational speed sensor detects a rotational speed exceeding the above-mentioned predetermined rotational speed, pressure of the oil pressure chamber 54*i* (54*e*) becomes high, and the actuator 51*i* (51*e*) becomes a second state that the drive piston 53*i* (53*e*) subjected to high pressure in the oil pressure chamber 54*i* (54*e*) and compresses the return spring 55 to occupy an advanced position.

The manipulating mechanism Mi (Me) includes the rod 50*i* (50*e*) and plural combinations of a pair of engaging pins 57*i*, 58*i* (57*e*, 578*e*) and a pair of drive spring 59*i*, 60*i* (59*e*, 60*e*) disposed within the rod 50*i* (50*e*). The rod has an end integrally connected to the drive piston 23*i* (23*e*) and another end supported by the cylinder head 3 so as to slide axially. Each combination of the engaging pins and the drive springs corresponds to each cylinder. In this embodiment, four such combinations are provided because the engine 1 has four cylinders. The rod 50*i* (50*e*) has four long holes 61*i* (61*e*). In each long hole 61*i* (61*e*), the projecting piece 46*i* (46*e*) of the corresponding support seat 31*i* (31*e*) is fitted so as to move in axial direction of the rod 50*i* (50*e*). Further, the rod has throttled portions 62*i* (62*e*) forming bearing seats for the drive springs 59*i*, 60*i* (59*e*, 60*e*).

The projecting piece 46*i* (46*e*) inserted in the long hole 61*i* (61*e*) is pinched by the engaging pins 57*i*, 58*i* (57*e*, 58*e*) which are pushed by the drive springs 59*i*, 60*i* (59*e*, 560*e*) against the projecting piece 46*i* (46*e*).

The long hole 61*i* (61*e*) has a wide portion 63*i* (63*e*) of width about equal to an inner diameter of the rod 50*i* (50*e*) provided at the middle of the long hole extending over a certain length. The engaging pins 57*i*, 58*i* (57*e*, 58*e*) and the drive springs 59*i*, 60*i* (59*e*, 60*e*) are inserted into the rod 50*i*

(50*e*) through the wide portion 63*i* (63*e*). On both sides of the long hole 61*i* (61*e*) are provided escape preventing portions 64*i* (64*e*) having a width smaller than that of the wide portion 63*i* (63*e*) for preventing the engaging pins 57*i*, 58*i* (57*e*, 58*e*) and the drive springs 59*i*, 60*i* (59*e*, 60*e*) from escaping out of the rod.

In the state that the rod 50*i* (50*e*) is attached to the cylinder head 3, the projecting piece 46*i* (46*e*) of the support seat 31*i* (31*e*) is engaged with the engaging pins 57*i*, 58*i* (57*e*, 58*e*) at a place outside of the spring seat 13*i* (13*e*), near the center axis Lc of the cylinder 5 and slightly under the receiving seat 29*i* (29*e*). Drive force of the actuator 51*i* (51*e*) is transmitted to the projecting piece 46*i* (46*e*) through the rod 50*i* (50*e*), the drive springs 59*i*, 60*i* (59*e*, 60*e*) and the engaging pins 57*i*, 58*i* (57*e*, 58*e*) to rotate the support seat 31*i* (31*e*) relatively to the base seat 30*i* (30*e*). Therefore, in the first embodiment, the support seat 31*i* (31*e*) is a driven seat driven by the drive force.

When pressure of the oil pressure chamber 54*i* (54*e*) is low and the actuator 51*i* (51*e*) is in the first state, the support seat 41*i* (31*e*) having the projecting piece 46*i* (46*e*) engaged with the engaging pins 57*i*, 58*i* (57*e*, 58*e*) occupies the aforementioned first position. When pressure of the oil pressure chamber 54*i* (54*e*) is high and the actuator 51*i* (51*e*) is in the second state, the support seat 31*i* (31*e*) occupies the aforementioned second position.

The drive force of the actuator 51*i* (51*e*) generated by the working oil of high pressure and the return spring is set at a predetermined value so that only when the support seat 31*i* (31*e*) occupies the second position and the roller 22*i* (22*e*) of the intake rocker arm 20*i* (the exhaust rocker arm 20*e*) comes into sliding contact with the base circle portion of the intake cam 18*i* (the exhaust cam 18*e*) to close the intake valve 12*i* (the exhaust valve 12*e*), the support seat 31*i* (31*e*) can be rotated overcoming friction force between the support seat 31*i* (31*e*) and the base seat 30*i* (30*e*). The friction force is generated by spring force of the valve spring 15*i* (15*e*) at that time, namely by set load of the aforementioned second set value.

Next, working of the above-mentioned first embodiment will be described with reference to the FIGS. 6 to 9.

When the engine 1 is in the low rotational speed region, working oil pressure in the oil pressure chamber 54*i* (54*e*) of the actuator 51*i* (51*e*) is controlled low by the oil pressure control valve and the actuator 51*i* (51*e*) is in the first state as shown in FIG. 6. In this state, the actuator generates no drive force and the projecting piece 46*i* (46*e*) is pushed from both sides equally by the drive springs 59*i*, 60*i* (59*e*, 60*e*) through the engaging pins 57*i*, 58*i* (57*e*, 58*e*) to position the support seat 31*i* (31*e*) at the aforementioned first position. Set load of the valve spring 15*i* (15*e*) is set at the aforementioned smaller first set value to reduce friction. But, in this operation region (low rotational speed region), jumping and bounce are not generated.

When rotational speed of the engine 1 rises and exceeds the above-mentioned predetermined speed, pressure of the working oil in the oil pressure chamber 54*i* (54*e*) of the actuator 51*i* (51*e*) becomes high by controlling of the oil pressure control valve, and the actuator 51*i* (51*e*) becomes the second state to generate drive force. The drive force is transmitted to the projecting piece 46*i* (46*e*) of the support seat 31*i* (31*e*) through the rod 50*i* (50*e*), the drive spring 59*i* (59*e*) and the engaging pin 57*i* (57*e*).

Since the drive force is set at the aforementioned specific value, if the intake (exhaust) valve 12*i* (12*e*) is closed, the support seat 31*i* (31*e*) rotates immediately in a normal direction by the aforementioned specific amount to occupy the second position where the second contact surface 37*i* (37*e*) of the lower cam surface 39*i* (39*e*) is contacted with the second contact surface 43*i* (43*e*) of the upper cam surface 53*i* (53*e*). Thus, the drive piston 53*i* (53*e*), the rod 50*i* (50*e*), the drive springs 59*i*, 60*i* (59*e*, 60*e*), the engaging pins 57*i*, 58*i* (57*e*, 58*e*) and the projecting piece 46*i* (46*e*) occupy positions shown in FIG. 8.

Even if the intake (exhaust) valve 12*i* (12*e*) is opened when rotational speed of the engine 1 exceeds the predetermined rotational speed, if spring force of the valve spring 15*i* (15*e*) is smaller then the set load of the second set value, the support seat 31*i* (31*e*) begins to rotate in the normal direction immediately by drive force of the actuator 51*i* (51*e*) acting on the projecting piece 46*i* (46*e*) through the rod 50*i* (50*e*), the drive spring 59*i* (59*e*) and the engaging pin 57*i* (57*e*). The support seat 31*i* (31*e*) rotates with the inclined surface 44*i* (44*e*) of the upper cam surface 45*i* (45*e*) sliding on the inclined surface 38*i* (38*e*) of the lower cam surface 39*i* (39*e*). But, as far as the intake (exhaust) valve 12*i* (12*e*) is opened, a state that the inclined surfaces 38*i*, 44*i* (38*e*, 44*e*) are in contact with each other is maintained, and when the intake (exhaust) valve 12*i* (12*e*) is closed, the support seat 31*i* (31*e*) rotates in the normal direction further to occupy the second position. Thus, the drive piston 53*i* (53*e*), the rod 50*i* (50*e*), the drive springs 59*i*, 60*i* (59*e*, 60*e*), the engaging pins 57*i*, 58*i* (57*e*, 58*e*) and the projecting piece 46*i* (46*e*) occupy positions shown in FIG. 8.

Figure 7:
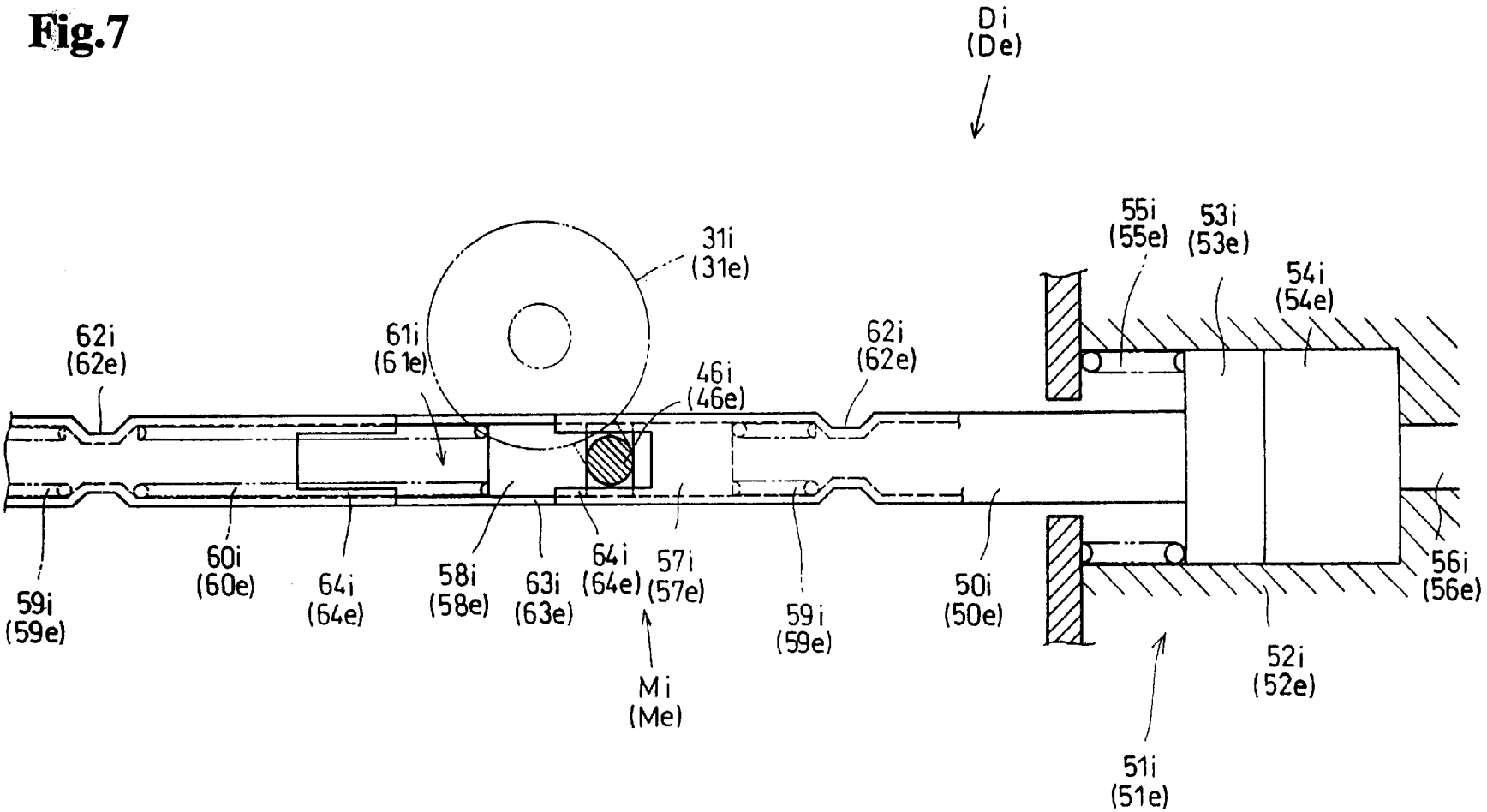
FIG. 7 is a view for explaining operation of the set load changing device in which the support seat occupies the first position and drive force of an actuator is stored in one of drive springs.
Figure 8:
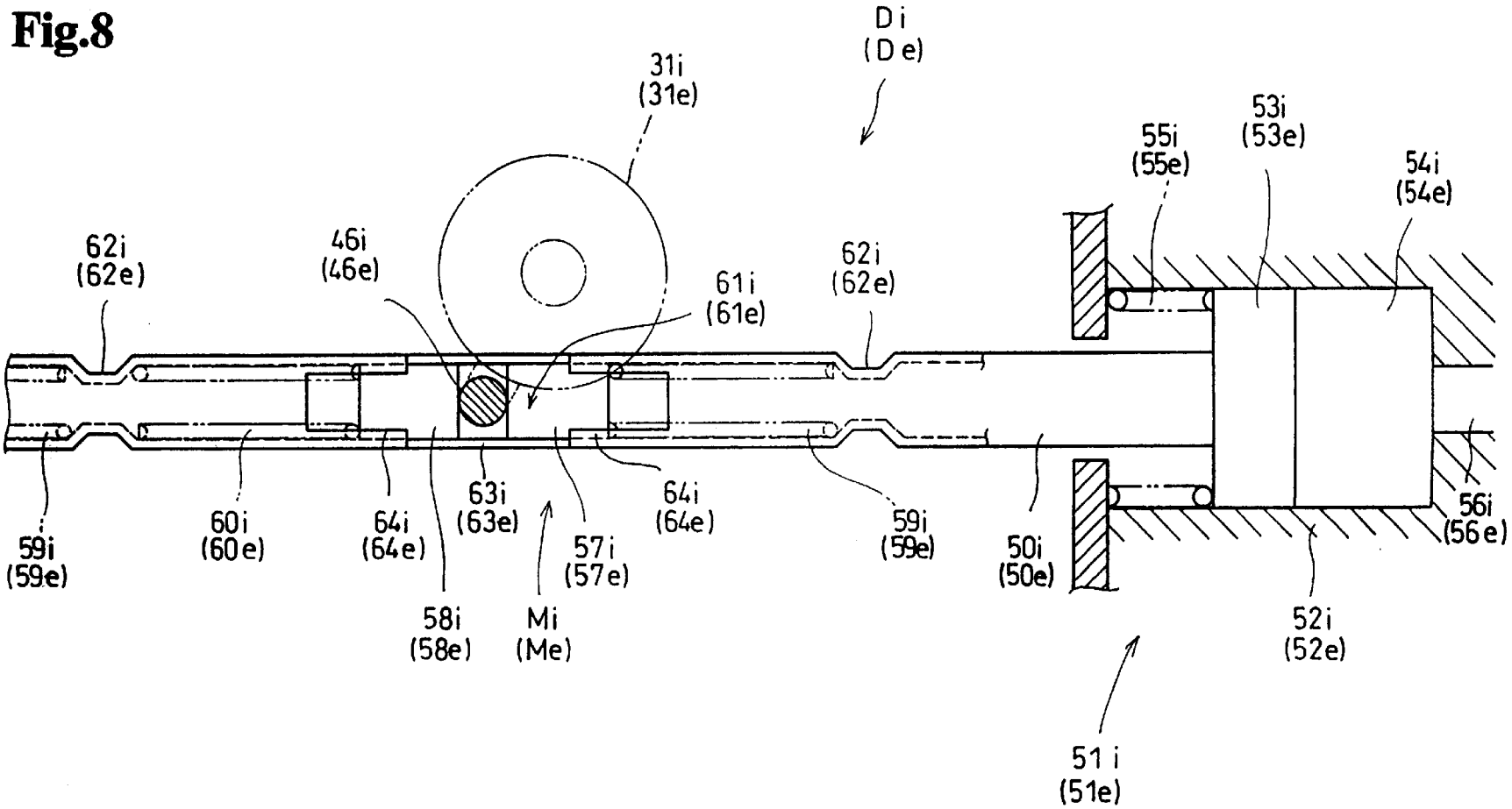
FIG. 8 is a view for explaining operation of the set load changing device in which the support seat occupies the second position.

When rotational speed of the engine 1 exceeds the predetermined rotational speed, if the intake (exhaust) valve 12*i* (12*e*) is opened and spring force of the valve spring 15*i* (15*e*) is higher than the set load of the second set value, as shown in FIG. 7, the drive spring 59*i* (59*e*) is compressed by the drive force transmitted from the drive piston 53*i* (53*e*) through the rod 50*i* (50*e*) and the drive force is stored in the drive spring 59*i* (59*e*) once. When the intake (exhaust) cam rotates further and spring force of the valve spring 15*i* (15*e*) becomes lower than the second set value, the drive force stored in the drive spring 59*i* (59*e*) acts on the projecting piece 46*i* (46*e*) through the engaging pin 57*i* (57*e*) to let the support seat 31*i* (31*e*) begin to rotate in the normal direction. And when the intake (exhaust) valve 12*i* (12*e*) is closed, the support seat 31*i* (31*e*) occupies the second position. In the high rotational speed region, this state is maintained.

Since set load of the valve spring 15*i* (15*e*) is set at the second set value larger than the first set value when the support seat 31*i* (31*e*) occupies the second position, jumping and bounce of the intake (exhaust) valve 12*i* (12*e*) in the high rotational speed region can be prevented.

After then, if rotational speed of the engine 1 is reduced to a rotational speed lower than the predetermined rotational speed, pressure of the working oil in the oil pressure chamber 54*i* (54*e*) of the actuator 51*i* (51*e*) becomes low and drive force generated by the return spring 55*i* (55*e*) acts on the projecting piece of the support seat 31*i* (31*e*) of the second position through the rod 50*i* (50*e*), the drive spring 60*i* (60*e*) and the engaging pin 58*i* (58*e*).

At that time, if the intake (exhaust) valve 12*i* (12*e*) is closed, the support seat 31*i* (31*e*) is rotated immediately in a reverse direction by the drive force of the actuator 51*i* (51*e*) acting on the projecting piece 46*i* (46*e*) through the rod 50*i* (50*e*), the drive spring 60*i* (60*e*) and the engaging pin 58*i* (58*e*) and occupies the first position where the first contact surface 35*i* (35*e*) of the lower cam surface 39*i* (39*e*) is contacted with the second contact surface 43*i* (43*e*) of the upper cam surface 45*i* (45*e*) and the second contact surface

37*i* (37*e*) of the lower cam surface 39*i* (39*e*) is contacted with the first contact surface 41*i* (41*e*) of the upper cam surface 45*i* (45*e*). The drive piston 53*i* (53*e*), the rod 50*i* (50*e*), the drive springs 59*i*, 60*i* (59*e*, 60*e*), the engaging pins 57*i*, 58*i* (57*e*, 58*e*) and the projecting piece 46*i* (46*e*) occupy positions shown in FIG. 6.

Figure 9:
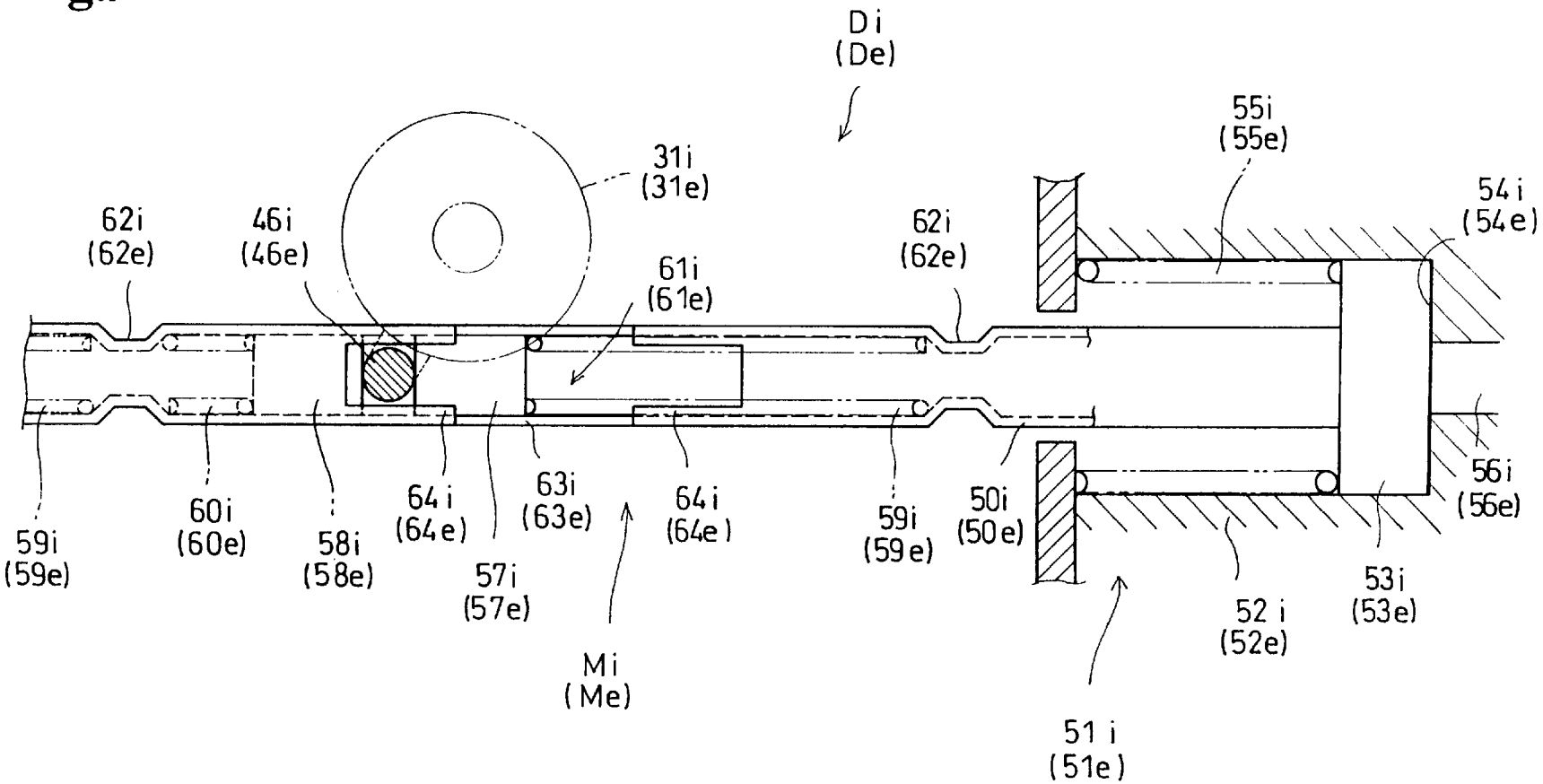
FIG. 9 is a view for explaining operation of the set load changing device in which the support seat occupies the second position and drive force of the actuator is stored in another drive spring.

When rotational speed of the engine 1 is reduced to a rotational speed lower than the predetermined rotational speed, if the intake (exhaust) valve 12*i* (12*e*) is opened, spring force of the valve spring 15*i* (15*e*) is higher than the set load of the second set value, and therefore, as shown in FIG. 9, the drive spring 60*i* (60*e*) is compressed by the drive force transmitted from the drive piston 53*i* (53*e*) through the rod 50*i* (50*e*) and the drive force is stored in the drive spring 60*i* (60*e*) once. When the intake (exhaust) cam 18*i* (18*e*) rotates further and spring force of the valve spring 15*i* (15*e*) becomes lower than the second set value, the drive force stored in the drive spring 60*i* (60*e*) acts on the projecting piece 46*i* (46*e*) through the engaging pin 58*i* (58*e*) to let the support seat 31*i* (31*e*) begin to rotate in the reverse direction. And when the intake (exhaust) valve 12*i* (12*e*) is closed, the support seat 31*i* (31*e*) occupies the second position. In the low rotational speed region, this state is maintained.

In this manner, support seats for four intake valves 12*i* of the engine 1 and support seats 31*e* for four exhaust valves 12*e* of the engine 1 are rotated in order by the actuator 51*i* (51*e*) and the manipulating mechanism Mi (Me) to change set loads of the valve springs 15*i* (15*e*).

Hereinafter, Effects of the first embodiment will be described.

Since the support seat 31*i* (31*e*) is driven by the actuator 51*i* (51*e*) provided outside of the spring seat 13*i* (13*e*) through the manipulating mechanism Mi (Me), it is required in order to cause relative rotation between the support seat 31*i* (31*e*) and the base seat 30*i* (30*e*) that only the manipulating mechanism Mi (Me) engaging with the support seat (driven seat) 31*i* (31*e*) is provided in the neighborhood of the spring seat 13*i* (13*e*). Further, since the manipulating mechanism Mi (Me) can be engaged with the support seat 31*i* (31*e*) at any position in the neighborhood of the spring seat 13*i* (13*e*), arrangement of the engine valve is restrained little.

As the result, a part of the cylinder head 3 around the spring seat 13*i* (13*e*) does not enlarged, so that enlargement and weight-increase of the entire cylinder head can be restrained. Further, degree of freedom of arrangement of the support seat 31*i* (31*e*) and the manipulating mechanism Mi (Me) in the neighborhood of the spring seat 13*i* (13*e*) is large, and restriction to arrangement of the intake (exhaust) valve 12*i* (12*e*) owing to the set load changing device Di (De) becomes little.

Since the support seat 31*i* (31*e*) is driven through the rod 50*i* (50*e*) connected to the actuator 51*i* (51*e*), the actuator 51*i* (51*e*) is disposed at an end portion of the cylinder head 3 remote from the spring seat 13*i* (13*e*). As the result, degree of freedom of arrangement of the actuator 51*i* (51*e*) becomes large, and restriction to arrangement of the intake (exhaust) valve 12*i* (12*e*) owing to the set load changing device Di (De) can be made little.

Since the rod 50*i* (50*e*) is disposed utilizing the relatively narrow space between the intake (exhaust) valve 12*i* (12*e*) and the insertion hole 18 for the ignition plug 16, the manipulating mechanism Mi (Me) can be disposed within the cylinder head 3 compactly and enlargement of the cylinder head 3 can be restrained.

In the 4-cylinder internal combustion engine 1, four support seats 31*i* for the intake valves 12*i* are driven by one manipulating mechanism Mi and four support seats 12*e* for the exhaust valves 12*e* are driven by one manipulating mechanism Me. Namely, one manipulating mechanism Mi (Me) can be used commonly to plural intake (exhaust) valves 12*i* (12*e*). Therefore, number of parts is reduced, assembling work is improved and enlargement and weight-increase of the cylinder head can be restrained. Moreover, since the rod 50*i* (50*e*) is disposed in parallel with the intake (exhaust) camshaft 7*i* (7*e*) extending in direction of row of cylinders, enlargement of the cylinder head 3 can be further restrained.

When the intake (exhaust) valve 12*i* (12*e*) is closed and the valve spring 15*i* (15*e*) is expanded to minimize spring force of the valve spring 15*i* (15*e*), if drive force of the actuator 51*i* (51*e*) acts on the support seat 31*i* (31*e*) through the manipulating mechanism Mi (Me), relative movement of a predetermined amount is caused between the support seat 31*i* (31*e*) and the base seat 30*i* (30*e*) and the support seat 31*i* (31*e*) is moved in direction of expansion and contraction of the valve spring 15*i* (15*e*) through the direction changing mechanism to change set load of the valve spring 15*i* (15*e*). When the intake (exhaust) valve 12*i* (12*e*) is opened and the valve spring 15*i* (15*e*) is more compressed to increase spring force of the valve spring 15*i* (15*e*), even if drive force of the actuator 51*i* (51*e*) is generated, the support seat 31*i* (31*e*) can not be rotated because spring force of the valve spring 15*i* (15*e*) is large. Therefore, the drive springs 59*i*, 60*i* (59*e*, 60*e*) are deformed elastically and store the drive force. After then, when the intake (exhaust) valve 12*i* (12*e*) is closed and spring force of the valve spring 15*i* (15*e*) is minimized, the drive force stored in the drive springs 59*i*, 60*i* (59*e*, 60*e*) drives the support seat 31*i* (31*e*) to cause relative movement of the predetermined amount between the support seat 31*i* (31*e*) and the base seat 30*i* (30*e*) and change set load of the valve spring 15*i* (15*e*). In case that plural support seats of the intake (exhaust) valves are driven by a common manipulating mechanism Mi (Me), set loads of the valve springs 15*i* (15*e*) are changed in order when the respective intake (exhaust) valves are closed.

If only the drive force of the actuator 51*i* (51*e*) is set at a specific value so that the drive force can drive the support seat 31*i* (31*e*) when the intake (exhaust) valve 12*i* (12*e*) is closed, always the set load can be changed surely and stably at a specific time that the intake (exhaust) valve 12*i* (12*e*) is closed. And it is unnecessary to adjust time for generating the drive force, therefore a control system of the actuator 51*i* (51*e*) becomes simple and cost of the engine 1 can be reduced.

At the second position of the support seat 31*i* (31*e*)for setting the set load of the valve spring 15*i* (15*e*) at the aforementioned larger second set value, the support seat 31*i* (31*e*) and the base seat 30*i* (30*e*) are contacted with each other through the second contact surface 37*i* (37*e*) and the second contact surface 43*i* (43*e*) which are on a plane right-angled to line of action of spring force of the valve spring 15*i* (15*e*). Therefore, even if the large spring force acts on the support seat 31*i* (31*e*) and the base seat 30*i* (30*e*) when the intake (exhaust) valve 12*i* (12*e*) is opened, a component force producing relative slip between the base seat 30*i* (30*e*) and the support seat 31*i* (31*e*) is not generated and fluctuation of the set load can be prevented.

As the result, the set load set in accordance with a rotational speed of the engine 1 can be maintained stably.

Next, a second embodiment of the present invention will be described. In the second embodiment, each cylinder of a 4-cylinder internal combustion engine has two intake valves and two exhaust valves, and construction of a spring seat is different from that of the first embodiment. Otherwise, the second embodiment has the same constitution as the first embodiment. Therefore, description regarding the same constitution will be omitted and the spring seat will be described mainly. Members which are the same as or corresponding to those of the first embodiment is designated by the same terms.

Figure 10:
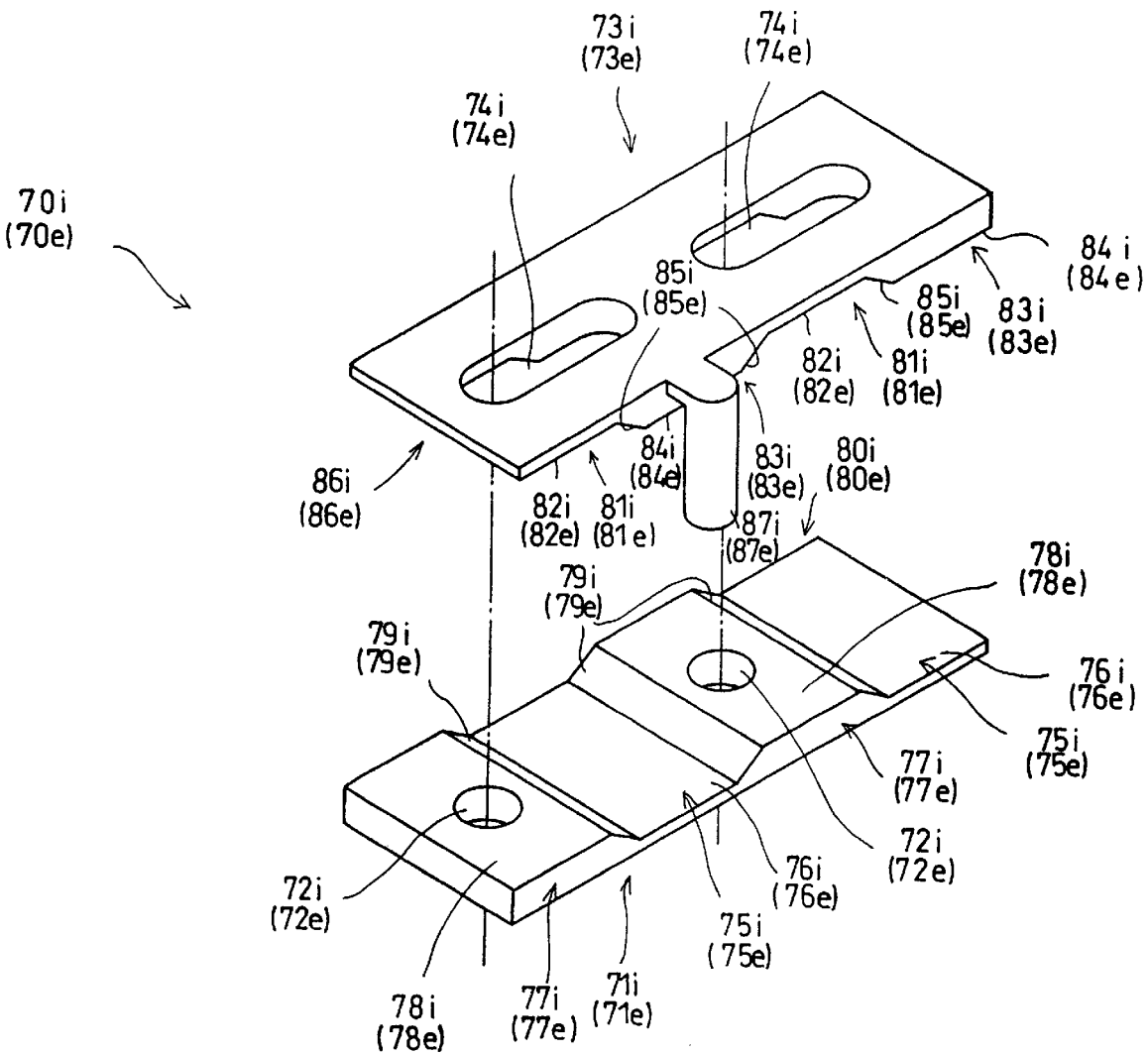
FIG. 10 is a perspective view of a spring seat constituting a set load changing device according to a second embodiment of the present invention.

A spring seat 70*i* (70*e*) shown in FIG. 10 corresponds to a pair of intake (exhaust) valves for each cylinder. The spring seat 70*i* (70*e*) includes a rectangular-plate-like base seat 71*i* (71*e*) and a rectangular-plate-like support seat 73*i* (73*e*). The base seat 71*i* (71*e*) has two circular lower insertion holes 72*i* (72*e*) to be penetrated by valve guides and the support seat 73*i* (73*e*) has two elongated upper insertion holes 74*i* (74*e*) to be penetrated by the valve guides. The base seat 71*i* (71*e*) and the support seat 73*i* (73*e*) can be moved relatively in direction parallel with the axis of the intake (exhaust) camshaft. Namely, the base seat 71*i* (71*e*) is fitted in a recessed receiving seat of the cylinder head so as not to move, and the support seat 73*i* (73*e*) is disposed on the base seat 71*i* (71*e*) so as to move in direction parallel with the axis of the intake (exhaust) camshaft. The support seat supports valve springs.

On an upper surface of the base seat 71 i(71*e*), two bottom sections 75*i* (75*e*) each having a first contact surface 76*i* (76*e*) extending on an aforementioned right-angled plane (a plane right-angled to the axis of the intake (exhaust) valve) and top sections 77*i* (77*e*) each having a second contact surface 78*i* (78*e*) extending on a right-angled plane are arranged alternately in direction of the relative movement. The first contact surfaces 76*i* (76*e*) and the second contact surfaces 78*i* (78*e*) are connected with each other through inclined surfaces 79*i* (79*e*). The first and second contact surfaces 76*i*, 78*i* (76*e*, 78*e*) and the inclined surfaces 79*i* (79*e*) form a lower cam surface. The lower insertion holes 72*i* (72*e*) are provided at the top sections 77*i* (77*e*).

On a lower surface of the support seat 73*i* (73*e*), two bottom sections 81*i* (81*e*) each having a first contact surface 82*i* (82*e*) extending on a right-angled plane and two top sections 83*i* (83*e*) each having a second contact surface 84*i* (84*e*) extending on a right-angled plane are arranged alternately in direction of the relative movement. The first contact surfaces 82*i* (82*e*) and the second contact surfaces 84*i* (84*e*) are connected with each other through inclined surfaces 85*i* (85*e*). The first and second contact surfaces 82*i*, 84*i* (82*e*, 84*e*) and the inclined surfaces 85*i* (85*e*) form an upper cam surface 86*i* (86*e*). Further, the support seat 73*i* (73*e*) has columnar projecting piece 86*i* (86*e*) extending downward from a long side portion of the support seat 73*i* (73*e*). Drive force of an actuator acts on the projecting piece 86*i* (86*e*) in the same manner as the first embodiment. The length of the elongated upper insertion hole 74*i* (74*e*) is determined so that the valve guide does not obstruct movement of the support seat 73*i* (73*e*) when the support seat moves relatively to the base seat. Therefore, in the second embodiment, the support seat 73*i* (73*e*) constitutes the driven seat. The drive force of the actuator is set larger than that of the first embodiment because the support seat 73*i* (73*e*) supports two intake (exhaust) valves.

When the support seat 73*i* (73*e*) occupies a first position relative to the base seat 71*i* (71*e*), the bottom section 75*i* (75*e*) and the top section 77*i* (77*e*) of the base seat 71*i* (71*e*) are opposite to the top section 83*i* (83*e*) and the bottom section 81*i* (81*e*) of the support seat 73*i* (73*e*) respectively, the first contact surface 76*i* (76*e*) is contacted with the second contact surface 84*i* (84*e*) almost entirely, the second contact surface 78*i* (78*e*) is contacted with the first contact surface 82*i* (82*e*) almost entirely, and a slight gap is formed between the inclined surface 79*i* (79*e*) of the lower cam surface 80*i* (80*e*) and the inclined surface 85*i* (85*e*) of the upper cam surface 86*i* (86*e*). In this first position, set load of the valve spring is set at a first set value.

When the support seat 73*i* (73*e*) moves by a predetermined amount relatively to the base seat 71*i* (71*e*) and occupies a second position, the bottom section 75*i* (75*e*) and the top section 77*i* (77*e*) of the base seat 71*i* (71*e*) are opposite to bottom section 81*i* (81*e*) and the top section 83*i* (83*e*) of the support seat 73*i* (73*e*) respectively, the second contact surface 78*i* (78*e*) and the second contact surface 84*i* (84*e*) are contacted with each other almost entirely, and gaps are formed between the first contact surface 76*i* (76*e*) and the first contact surface 82*i* (82*e*) and between the inclined surface 791 (79*e*)and the inclined surface 85*i* (85*e*). In this second position, set load of the valve spring is set at a second set value larger than the first set value.

Working of the second embodiment is basically the same as working of the first embodiment, except that the single support seat 73*i* (73*e*) supports two valve springs, the support seat 73*i* (73*e*) moves linearly and the valve guide moves relatively to the support seat 73*i* (73*e*) along the major diameter of the upper insertion hole 74*i* (74*e*) when the support seat moves linearly.

According to the second embodiment, two valve springs for intake (exhaust) valves are supported by a common support seat 731 (73*e*). As the result, number of parts is reduced, number of the actuators and manipulating mechanisms is also reduced, assembling work is improved, and restriction to arrangement of members around the set load changing device is little.

In the internal combustion engine of the above-mentioned embodiments, combustible mixture is supplied to the combustion chamber through the intake passage. However, a fuel injection valve facing the combustion chamber may be fitted to the cylinder head for supplying fuel into the combustion engine directly. In this case, the fuel injection valve is inserted in the insertion hole for the ignition plug in the above-mentioned embodiments, and the ignition plug is inserted in another insertion hole. And the rod constituting the manipulating mechanism is provided in the narrow space between the insertion hole for the fuel ignition valve and the intake (exhaust) valve.

In the above-mentioned embodiments, the set load of the valve spring is changed in two steps. However, the set load can be changed in three or more steps by providing plural top sections having different heights. Though the actuator in the above-mentioned embodiments is a single-acting cylinder type hydraulic actuator, a hydraulic actuator having a double-acting cylinder type drive piston may be used. In this case, pressure of working oil supplied to both oil pressure chambers may be controlled by a single linear solenoid valve. The oil pressure cylinder of the actuator may be formed as a body separated from the cylinder head. In this case, assembling of the actuator becomes easy.

In the above-mentioned embodiments, an actuator and a manipulating mechanism for the intake valves and, an actuator and a manipulating mechanism for the exhaust valves are provided. However, plural actuators and plural manipulating mechanisms for the intake valves and plural actuators and plural manipulating mechanisms for the exhaust valves may be provided if necessary.

In the above-mentioned embodiments, the support seat is the driven seat. But the base seat or both the support and base seats may be the driven seat. In case that the both support and base seats are the driven seats, the support seat and the base seat are driven by respective actuators and manipulating mechanisms. The base seat may be formed integrally with the cylinder head.

In the first embodiment, the lower cam surface and the upper cam surface have three top sections and three bottom sections respectively. However, the cam face may have two, four or more than four top sections and bottom sections. If the cam face has four or more than four top sections and bottom sections, the required relative movement can be realized by a smaller rotational angle, and a set load changing device having a disk-like spring seat can be applied easily to an internal combustion engine having two intake valves and two exhaust valves per cylinder.

What is claimed is:

1. A valve spring set load changing device in a valve moving apparatus of an internal combustion engine having an engine valve for opening and closing a port of a combustion chamber connected with an intake passage or an exhaust passage, a valve spring for forcing said engine valve in a closing direction, a spring seat for supporting an end of said valve spring and a cam for opening said engine valve against said valve spring, wherein: said spring seat includes a base seat and a support seat supporting said end of said valve spring and movable relatively to said base seat, said base seat and said support seat are provided with a direction changing mechanism for changing relative movement between said base seat and said support seat into movement of said support seat in direction of expansion and contraction of said valve spring, an actuator for generating a drive force in accordance with an operational condition of said internal combustion engine and a manipulating mechanism connected with said actuator are provided outside of said spring seat, and at least one of said support seat and said base seat constitutes a driven seat driven by said drive force transmitted through said manipulating mechanism to cause said relative movement of a predetermined amount for changing set load of said valve spring.

2. A valve spring set load changing device as claimed in claim 1, wherein said manipulating mechanism has a rod connected to said actuator, and an engaging section of said rod and an engaging section of said driven seat are engaged with each other to connect said driven seat with said manipulating mechanism.

3. A valve spring set load changing device as claimed in claim 2, wherein said internal combustion engine has a cylinder head provided with an insertion hole for inserting an ignition plug or a fuel injection valve facing said combustion chamber, and said rod is disposed between said engine valve and said insertion hole.

4. A valve spring set load changing device as claimed in claim 1, wherein said internal combustion engine has said engine valves with said respective driven seats, and said driven seats are connected with a single manipulating mechanism.

5. A valve spring set load changing device as claimed in claim 1, wherein said support seat supports a plurality of said valve springs.

6. A valve spring set load changing device as claimed in claim 1, wherein said drive force of said actuator is set so that said driven seat is driven to cause said relative movement of said predetermined amount only when said engine valve is closed, said manipulating mechanism has an elastic deformation member storing said drive force generated by said actuator, and said drive force is transmitted to said driven seat through said elastic deformation member.

7. A valve spring set load changing device as claimed in claim 1, wherein said support seat has a first position where said set load of said vale spring is set at a first set value and a second position where said set load of said valve spring is set at a second set value larger than said first set valve by movement of said support seat in direction to contract said valve spring, and at said second position, said base seat and said support seat come into contact with each other through contact surfaces on a plane right-angled to a line of action of spring force of said valve spring.

* * * * *